US005158648A

United States Patent [19]

Weldon

[11] Patent Number: 5,158,648

[45] Date of Patent: Oct. 27, 1992

[54] APPARATUS FOR FORMING A MOVABLE THREADING TAIL

[76] Inventor: Scott B. Weldon, 733 Parrott Dr., San Mateo, Calif. 94402

[21] Appl. No.: 732,350

[22] Filed: Jul. 17, 1991

Related U.S. Application Data

[63] Continuation of Ser. No. 494,802, Mar. 14, 1990, abandoned, which is a continuation of Ser. No. 248,628, Sep. 26, 1988, abandoned.

[51] Int. Cl.[5] ..... D21F 7/00

[52] U.S. Cl. ..... 162/193; 162/194; 162/286; 83/425.4; 83/499

[58] Field of Search ..... 162/193, 194, 286; 83/425.2, 425.4, 498, 499

[56] References Cited

U.S. PATENT DOCUMENTS

| | | | |
|---|---|---|---|
| 327,031 | 9/1885 | Smith | 100/166 |
| 1,338,094 | 4/1920 | Pope | 92/49 |
| 1,369,124 | 2/1921 | Pope | 92/38 |
| 1,662,200 | 3/1928 | Merrill | 92/38 |
| 1,688,267 | 10/1928 | Cram | 92/49 |
| 1,937,360 | 11/1933 | Rosener | 83/499 |
| 2,529,184 | 11/1950 | Pearson | 271/2.1 |
| 3,088,355 | 5/1963 | Hornbostel | 83/177 |
| 3,213,735 | 10/1965 | Keferstein | 83/353 |
| 3,355,349 | 11/1967 | Devlin | 162/286 |
| 3,582,466 | 6/1971 | Quirk | 162/286 |
| 3,625,813 | 12/1971 | Eckelman | 162/193 |
| 3,762,250 | 10/1973 | Huskey | 83/425.2 |
| 3,935,776 | 2/1976 | Dingus | 83/425.4 |
| 4,022,094 | 5/1977 | Hetherington | 83/425.4 |
| 4,416,312 | 11/1983 | Östberg | 83/425.2 |
| 4,501,643 | 2/1985 | Kiuru | 162/286 |
| 4,566,944 | 1/1986 | Mauranen | 162/193 |

FOREIGN PATENT DOCUMENTS

| | | |
|---|---|---|
| 2441225 | 3/1975 | Fed. Rep. of Germany . |
| 4617057 | 7/1968 | Japan . |
| 58-110275 | 6/1983 | Japan . |

*Primary Examiner*—Stanley S. Silverman
*Assistant Examiner*—Christopher Upton
*Attorney, Agent, or Firm*—Law Offices of James E. Eakin

[57] ABSTRACT

Apparatus and methods of the invention create a movable paper machine threading tail that can be shifted away from the front ends of downstream rolls, thereafter to be widened symmetrically from a central position of the machine. Embodiments of the improvement comprise two independently traversable cutting assemblies mounted on one or more transverse service beams. Each cutting assembly comprises a traversing carriage upon which is mounted an appropriate web cutting device. Carriage positioning and cut activation are controlled in a way that one of said tools replaces the machine's somewhat permanently positioned front deckle squirt in defining the front most edge of a threading tail. Apparatus of the improvement also provide the means of creating and removing a sample from a main web without interrupting the path of the web through the machine thereby avoiding the need to re-thread following sampling procedures.

5 Claims, 17 Drawing Sheets

SECTION B–B

SECTION B–B

SECTION A–A

SECTION B–B

APPARATUS FOR FORMING A MOVABLE THREADING TAIL

This application is a continuation of application Ser. No. 07/494,802, filed Mar. 14, 1990, now abandoned which is a continuation of application Ser. No. 07/248,628, filed Sep. 26, 1988, now abandoned.

FIELD OF IMPROVEMENT

The invention relates generally to paper machines and paper making methods and, more particularly to apparatus and methods of forming a unique movable tail and for symmetrically widening the tail during the final phase of a threading sequence. The apparatus of the invention also relates to a novel procedure for obtaining samples from a running web during its manufacture on a paper machine.

BACKGROUND

Depending upon the machine and grade being made, the time lost recovering from web breaks is often equal to the down time for maintenance and clothing changes. Re-threading a paper machine following a break typically takes from several minutes to several tens of minutes and, on certain grades an hour is not uncommon. Therefore, papermakers have good reason to refine and improve the apparatus and methods of threading since every minute of lost time on a modern paper machine represents a significant economic penalty.

To affect recovery from a break, a narrow ribbon, referred to as a tail, is continuously cut from the front margin of the full web at a station up-stream from the point where the web broke. Once formed, the leading few feet of the tail are caused to enter the tail conveying ropes of the downstream section; a conveyor comprised of two endless ropes that trace the process path of each section. The following footage of the tail are thereby pulled through the path of the downstream section.

After the tail arrives at the outlet end of the rope conveyor, the speed of the downstream section is increased to first remove slack and then to establish normal running tension. Throughout this phase, and roughly in proportion to the progressive application of tension, the operator widens the tail to reduce the risk of its breaking. A section is successfully threaded when the tail obtains the width of the main web.

The same procedures are repeated at each following machine section until the full web is returned to the reel.

BRIEF DESCRIPTION OF THE DRAWINGS CONCERNING PRIOR ART

DESCRIPTION OF PRIOR ART

(1) Location of tail forming apparatus

Figure 1:
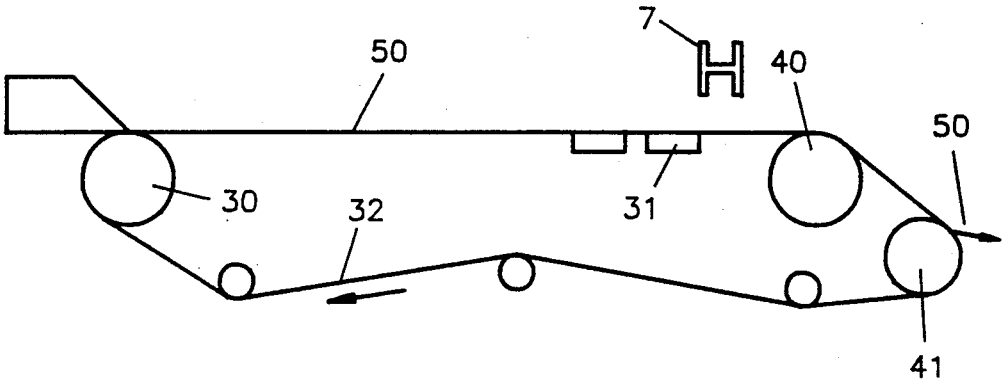
FIG. 1 is an elevation view of a typical paper machine fourdrinier section showing the usual site for tail making apparatus.

Referring now to FIG. 1 showing the typical layout of a fourdrinier section of a paper machine. Web 50 is formed on the top surface of endless wire 32. A conventional tail forming apparatus 7 denoted by an H-beam but generally of the type described in U.S. Pat. No. 3,625,813, spans wire 32 at a position between breast roll 30 and couch 40, specifically downstream from a last suction box 31. When the water squirt of said tail former is activated, web 50 is slit so as to form a tail from the front margin of said web.

Figure 2:
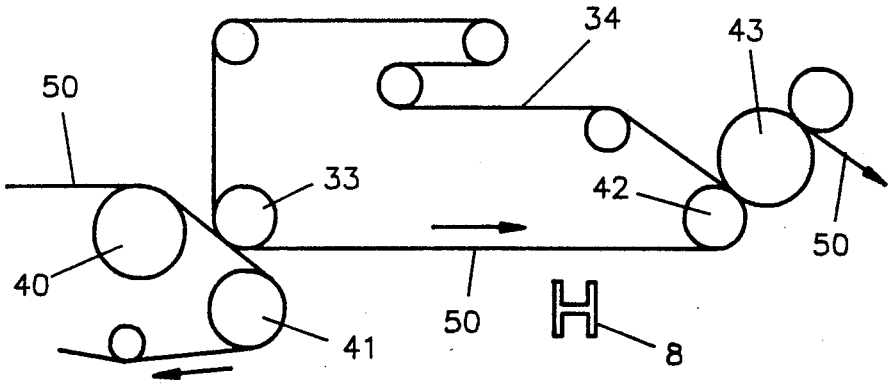
FIG. 2 is an elevation view of a typical paper machine press section showing the usual site for tail making apparatus.

Referring now to FIG. 2 showing the typical layout of a press section of a paper machine. A conventional tail forming apparatus 8, also denoted by an H-beam and generally of the type described in U.S. Pat. No. 3,625,813, is mounted beneath and spanning endless felt 34 at a position between wire turning roll 41 and first press roll 42. Wet web 50 adheres to the underside of endless felt 34 as a result of the suction of pick-up roll 33. When the upward pointing water squirt of said tail former is activated, web 50 is slit so as to form a tail from the front margin of said web.

Figure 3:
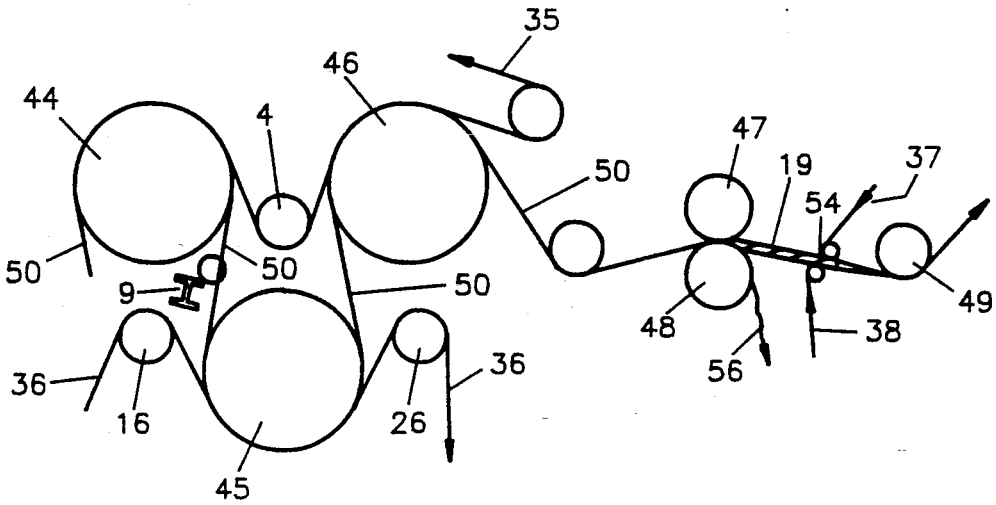
FIG. 3 is an elevation view of typical paper machine dryer and calender sections showing (a) the usual site for tail making apparatus and (b) the conventional apparatus used to convey a threading tail into a downstream section's rope conveyors.

Referring now to FIG. 3 showing the typical layout of the last elements of a dryer section. The significant elements are: endless felts 35 and 36; hitch rolls 4, 16 and 26; and dryers 44, 45 and 46. A conventional tail forming apparatus 9, denoted as an H-beam, is mounted within the pocket formed by web 50 as it wraps dryers 44,45,46. When a circular saw or spear mounted on said a traversable carriage of said tail former is activated, web 50 is slit so as to form a tail from the front margin of said web.

FIG. 3 also shows by way of example the auxiliary apparatus for and method of initiating the current threading procedure at a section break of a paper machine. Tail 54 is shown as having been created and together with the remainder 56 of web 50, exiting the nip of formed by calender rolls 47,48. While segment 56 drops away to a pulper located below the machine room floor, tail 54 is shown being induced by air chute 19 into the open nip of ropes 37,38. For a number of reasons, chute 19 never accelerates tail 54 sufficiently to match the speed of the downstream section; as a result, some slack is always created in said tail prior to being nipped by the conveyor ropes. Carrying sheaves mounted on the ends of all downstream rolls and dryers cause ropes 37,38 to run in contact with one another as they trace the path of the process. Said ropes thereby trap and convey the first or lead footage of tail 54 around the first roll 49 and so on through the section.

Figure 3A:
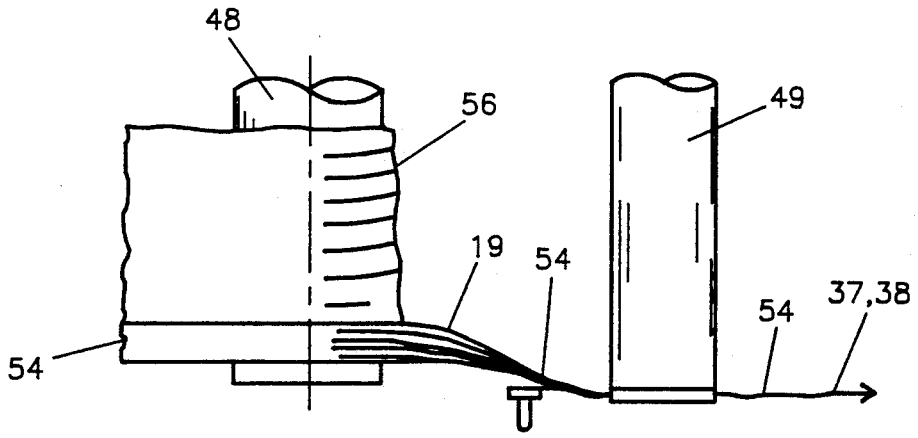
FIG. 3A is a plan view section of a calender section with its top roll removed to more clearly show the side-lay a tail must be forced to make in order to enter the rope conveyors.

Referring now to FIG. 3A of the calender section showing that ropes 37,38 run in sheaves well outside the normal or as-made path of web 50. In the view, top calender roll 47 is removed to better show the unnatural offset path tail 54 must be induced to take.

(2) Operation of conventional apparatus

The following and all future drawings including those of the improvement show a tail forming apparatus in an atypical position in the machine. This is done in the interest of making the operation of said apparatus more easily visualized.

Figure 4:
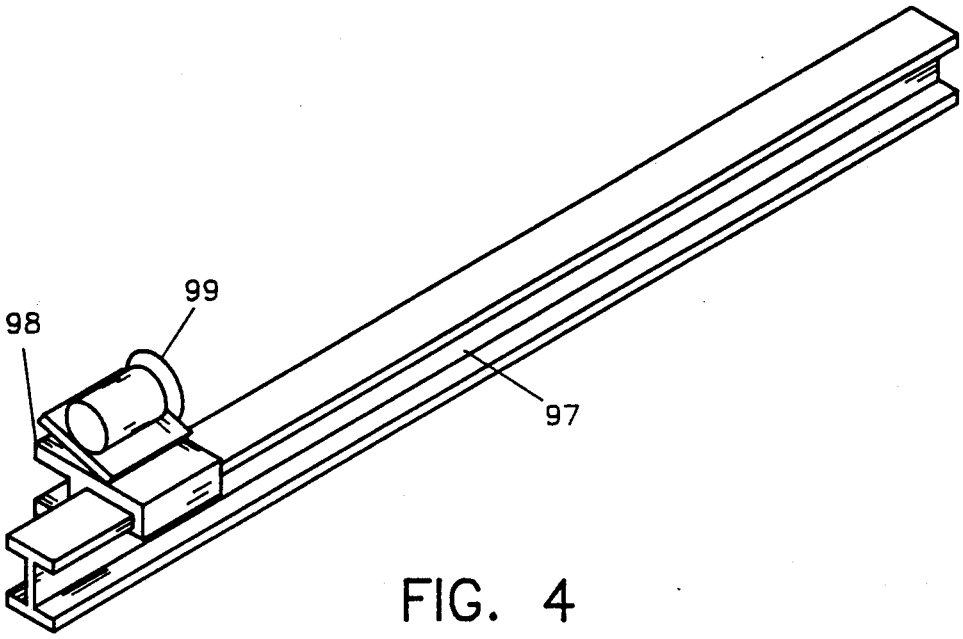
FIG. 4 is an isometric drawing of a typical and conventional tail making apparatus for a dry-end application, that is, the apparatus is equiped with a rotary saw.

FIG. 4 shows by way of example a conventional tail forming apparatus typical of many dry-end locations. Such apparatus comprise at least three basic components: a transverse service beam 97; a traversable carriage 98 and; a cutting tool, in the example circular saw 99.

Figure 4B:
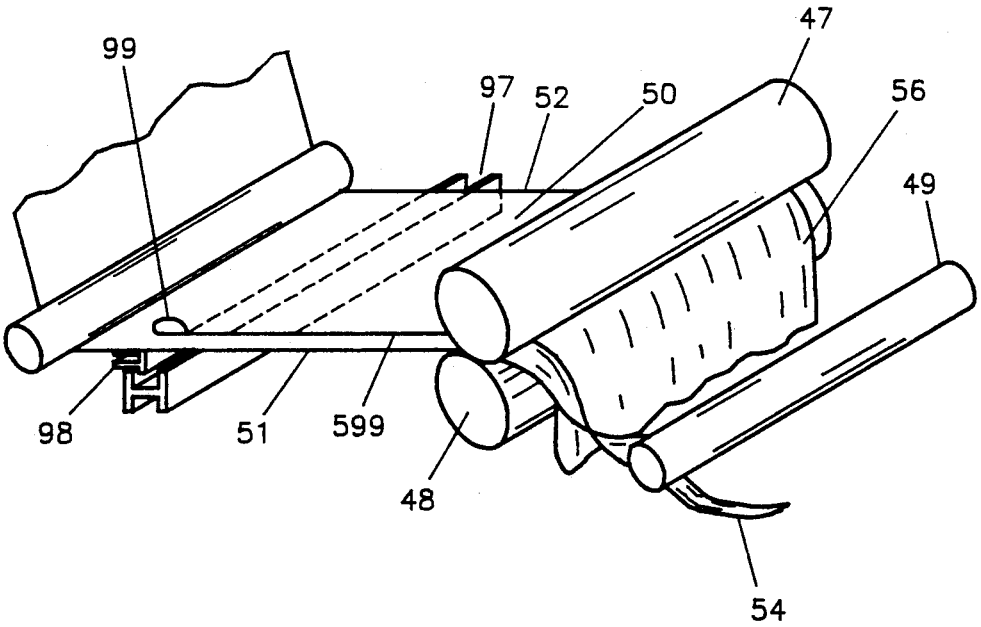
FIGS. 4B, 4C and 4D are isometric drawings showing the operation methods and problems with conventional tail making apparatus.
Figure 4C:
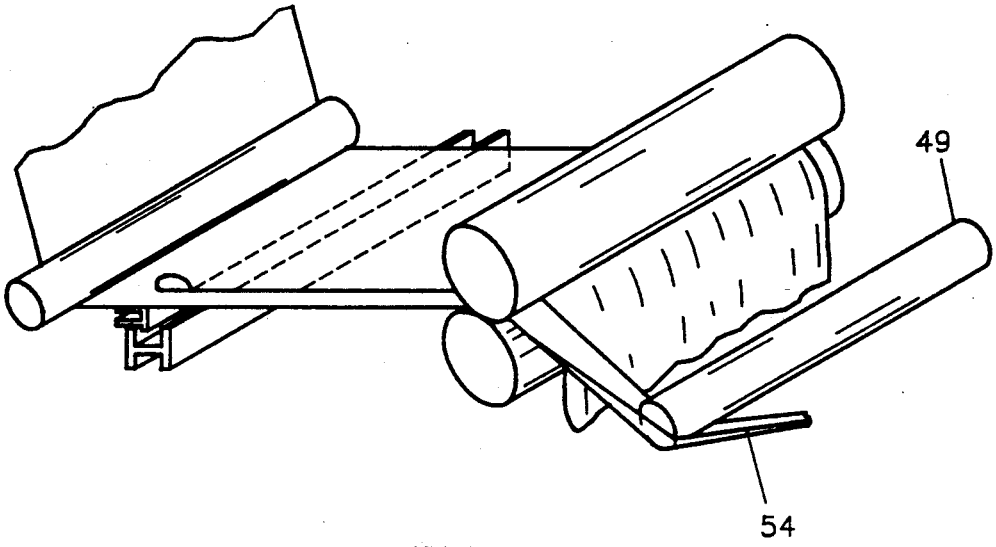
Figure 4D:
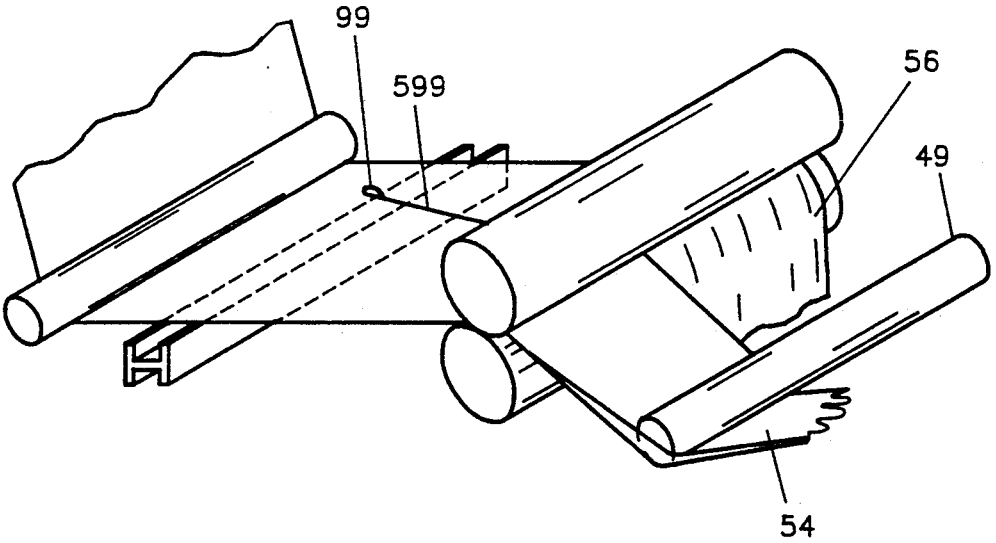

Referring now to FIGS. 4B, 4C and 4D. The procedures generally followed when a conventional tail forming apparatus is used is as follows:

1. Carriage 98 with saw 99 retracted is traversed along beam 97 to a position near the deckle edge 51 of web 50.
2. Saw 99 is raised to create slit 599. At this phase, the width of tail 54, defined by deckle edge 51 and slit 599 is adjusted to be very narrow, i.e. 4"-7". Sheet segment 56 and tail 54 drop by gravity into a pulper located below floor level.
3. Once chute 19 is put into position, tail 54 is broken as it exits nip 47,48 so as to make a leading edge. Refer to U.S. Pat. No. 4,501,643 for one method used to sever said tail. Simultaneously, tail 54 is induced by chute 19 to enter the open nip of conveying ropes 37,38. Only the leading few feet of tail 54, that portion grasped by said ropes will follow the offset running line of said ropes; all following footage of tail 54 reverts generally to its as-made line. It is important to understand that, although the following footage of tail 54 is pulled along by the captured segment of said tail, the path followed is a meandering one typically along the extreme front edges of downstream rolls and dryers.
4. Once tail 54 is established through the process path of the following section, the operator carefully increases the speed of that section, initially to remove slack from tail 54 thereby reducing the risk of said tail wandering off onto the journals of rolls such as 49.
5. As slack is removed but before significant tension is applied to tail 54, saw 99 is moved across the machine toward the back deckle edge 52. Said tail assumes a characteristic oblique shape as it is widened at the expense of web segment 56. Recovery is complete when saw 99 reaches the line of deckle edge 52.

PROBLEMS AND DISADVANTAGES OF CURRENT APPARATUS

(1) Problems

It can be appreciated that conventional apparatus makes one traversable slit to form a paper machine threading tail, the second edge of which is defined by a somewhat permanently positioned deckle edge; whereas on widening said tail, the apparatus creates an oblique draw, the apparatus comprising: a. a single traversable carriage on which is mounted a web cutting means for slitting said paper web; and (b) a transverse service beam means for mounting, driving and guiding the traversable carriage across the full width of the web.

The threading procedures just described must be repeated whenever:

1. Tail 54 is inadvertently broken when the operator over-shoots the tension said tail will tolerate.
2. See FIG. 4B. Because of back to front machine drafts, tail 54 tends to wander off the ends of downstream rolls before the operator can remove excess slack, thereby aborting the lacing attempt.
3. See FIG. 4C. Because of misaligned equipment, part of tail 54 can be guided to the front of the machine and off the face of downstream rolls, often breaking when the operator attempts to manually steer said tail.
4. See FIG. 4D. If the operator does not manually steer tail 54 back onto the face of downstream rolls and instead procedes to widen and apply tension, said tail breaks because of stress concentrations in the segment overhanging a roll.

Aside from the added time to repeat the threading sequence, whenever tail 54 breaks, fragments are broadcast throughout the following machine section. Additional time is normally taken to blow this broke clear of the machine's interior.

(2) Disadvantages

To appreciate why conventional tail forming apparatus create many of the problems encountered when threading a paper machine, one has to know that edges 51 and 52 which define the width of web 50 are formed by somewhat permanently positioned water squirts located at the machine's wet end. Economics cause papermakers to make their web as wide as possible, consequently, said squirts are somewhat permanently set as far apart as possible specifically to make deckle edges 51 and 52 as near the ends of the dryers as paper quality permits.

FIG. 4B clearly shows the problems conventional apparatus create as a result of the use of deckle 51 in defining the front most edge of tail 54. As the FIG. 4 shows, regardless of its width, the front margin of tail 54 always runs close to the ends of the machine's dryers and rolls. This peculiarity of conventional apparatus is the underlying cause of all following disadvantages:

A disadvantage of conventional apparatus is that tail 54 often meanders off the face of downstream rolls and dryers before any remedial action can be taken by the operator.

Another disadvantage is that operators must react quickly to the threat of tail 54 running off by increasing the speed of the downstream section to thereby remove slack from said tail. Inertia delays the response to speed commands thus it is not unusual that the operator, in his haste to remove slack in tail 54 and lacking immediate visual feed-back, over-shoots the tension said tail will tolerate.

Another disadvantage is that operators must often attempt to manually steer tail 54 away from the ends of downstream rolls and inadvertently break said web in the process.

Another disadvantage is that, as tension is being applied, misaligned rolls or excessively crowned spreading devices can steer tail 54 to the front side of the machine causing the front margin of said tail to ride over the end of one or more downstream rolls whereupon it ultimately breaks due to stress concentrations.

Another disadvantage is that tail 54 is widened from one side of the machine which creates the so-called oblique draw. The internal strains in a web of paper are somewhat symmetrical, being lowest in the central portions and highest at the deckle edges. Until the width of tail 54 exceeds the half width of the main web, unbalanced internal strains within said tail manifest themselves as so-called sheet flutter. Sheet flutter tends to mask the true tension being applied on said tail and can cause the operator to over shoot the tolerable level.

Another disadvantage is that operator judgement is so much a part of the threading process that attempts to automate conventional tail forming apparatus have not been successful.

Another disadvantage is that conventional tail forming apparatus is dedicated to that function and serve no other purpose.

OBJECTS AND ADVANTAGES OF THE IMPROVEMENT

It is an object of the invention to provide new and improved methods and apparatus for forming a threadinq tail from a web whereby the previously identified disadvantages of conventional apparatus and methods are eliminated.

Another object of the invention is to provide an apparatus and method for forming a threading tail which is movable in its entirety away from the front edge of the paper machine thereby removing the threat of said tail wandering off the ends of downstream rolls. Besides reducing the incidents of breaks caused by the tail actually running off roll ends, by eliminating the risk of tail wandering, operators will be less likely to hurry the removal of slack. Abruptness in this delicate operation usually leads to overshootinig the correct tension and directly causing the tail to break.

Another object of the invention is to provided the methods and apparatus which will allow a threading tail to be traversed in its entirety to a position near the centerline of the machine where the moisture content of said tail is higher. Under these more favorable conditions the tail's strength is increased and breaks caused by the tension of the draw on the narrow tail are reduced.

Another object of the invention is to provide the methods and apparatus to widen a threading tail symmetrically rather than obliquely thereby enabling the tail to contain balanced internal strains. With balanced strains, sheet flutter is reduced, enabling the operator to better judge the appropriateness of the slack take-up or tension being applied.

Another object of the invention is to provide apparatus for forming a threading tail the methods of which are readily managed by a computer thereby allowing the operator to concentrate on the difficult task of managing the slack take-up procedure.

Another object of the invention is to provide the methods and apparatus for forming narrow ample strips of any length and from any cross-machine position without interrupting the flow of the main web through the machine thereby saving the time of recovering from a deliberately broken web to obtain a similar sample.

BRIEF DESCRIPTION OF THE DRAWINGS OF THE IMPROVEMENT

Figure 5A:
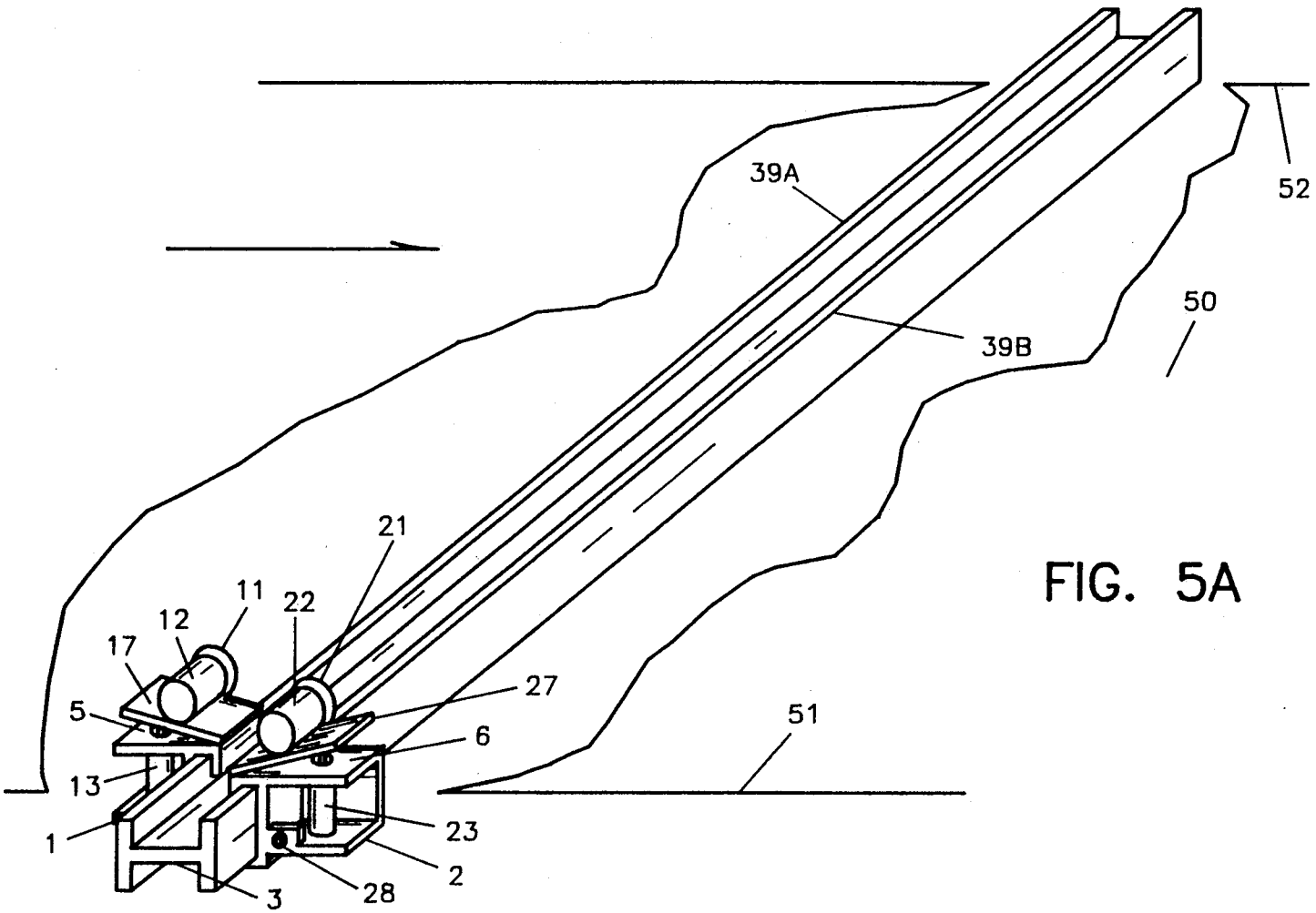

FIG. 5A is an isometric view of the preferred embodiment of the invention showing the position of its single beam relative to a continuous web within a paper machine.

Figure 5B:
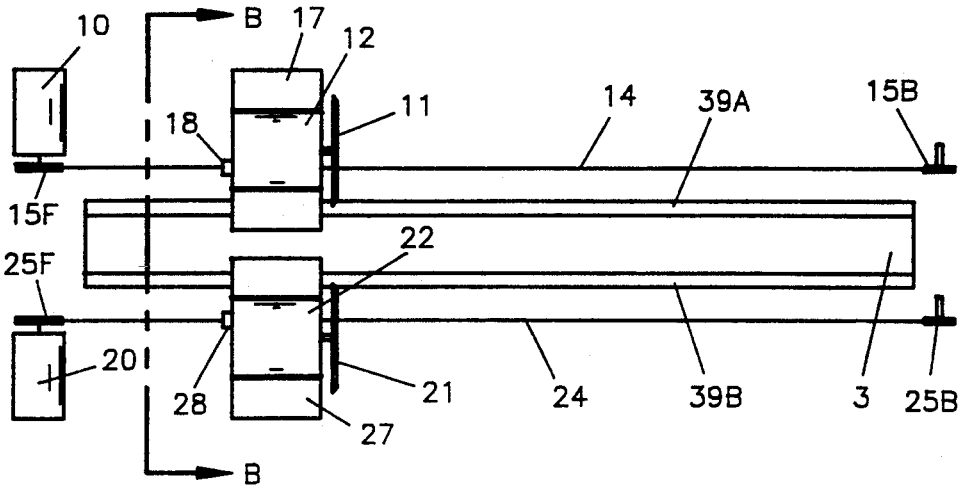
Figure 5C:
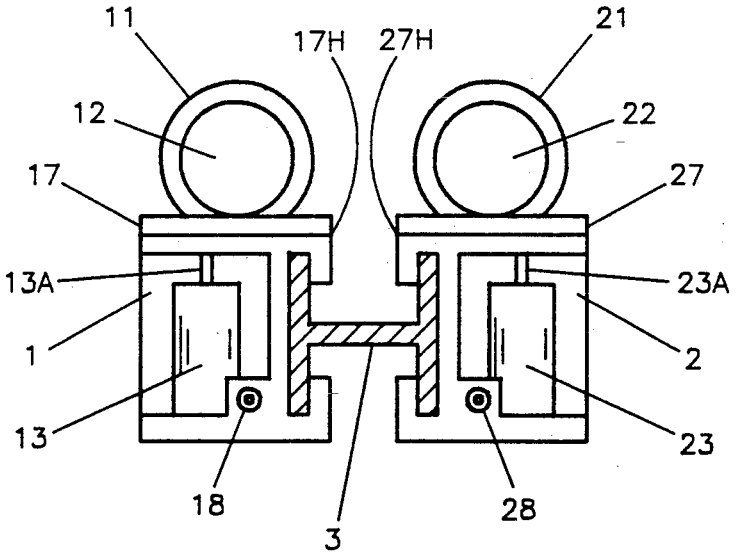
Figure 5D:
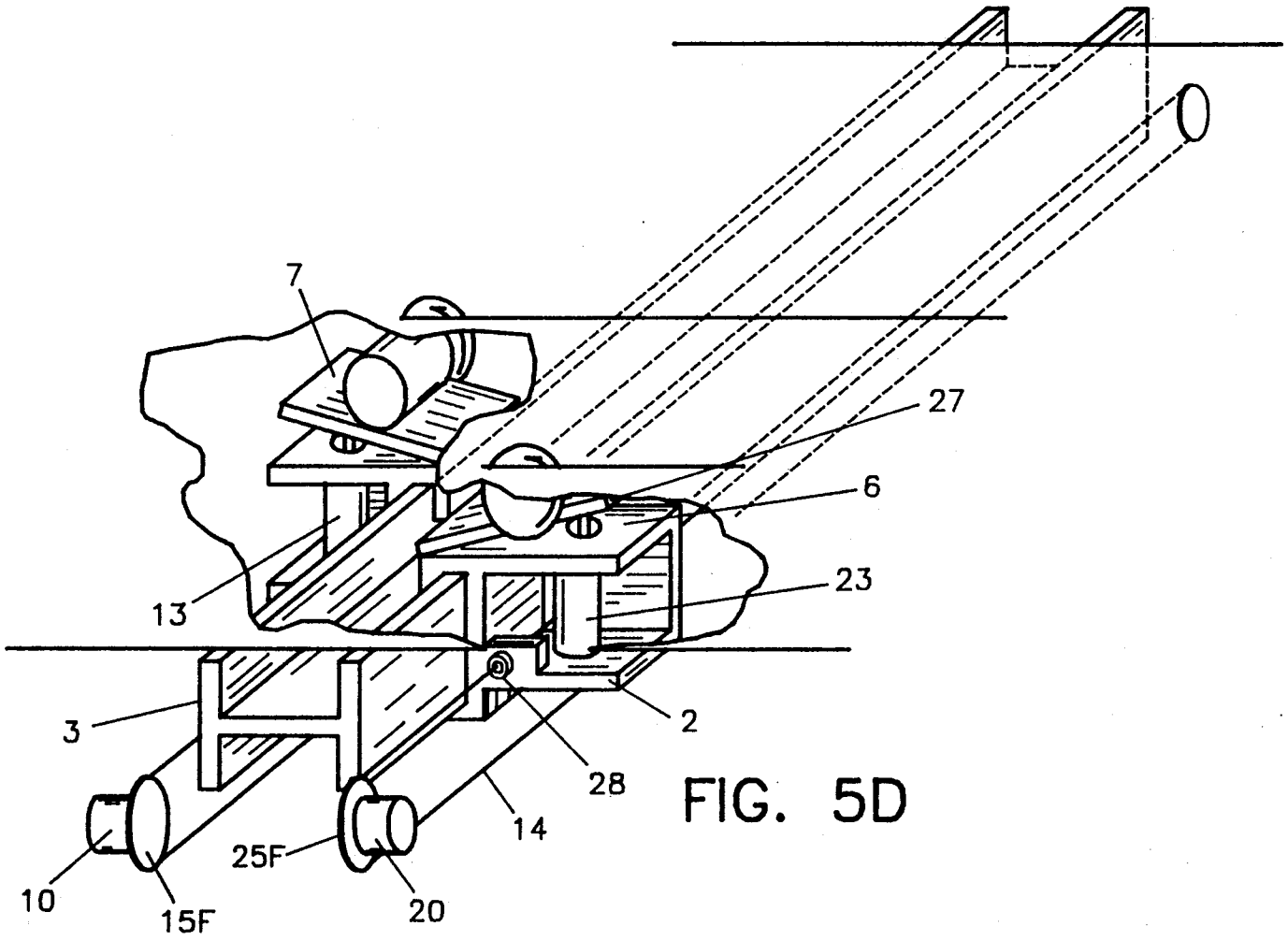

FIGS. 5B, 5C, and 5D are two plan views and vertical section B–B' of the preferred embodiment of the invention.

Figure 6A:
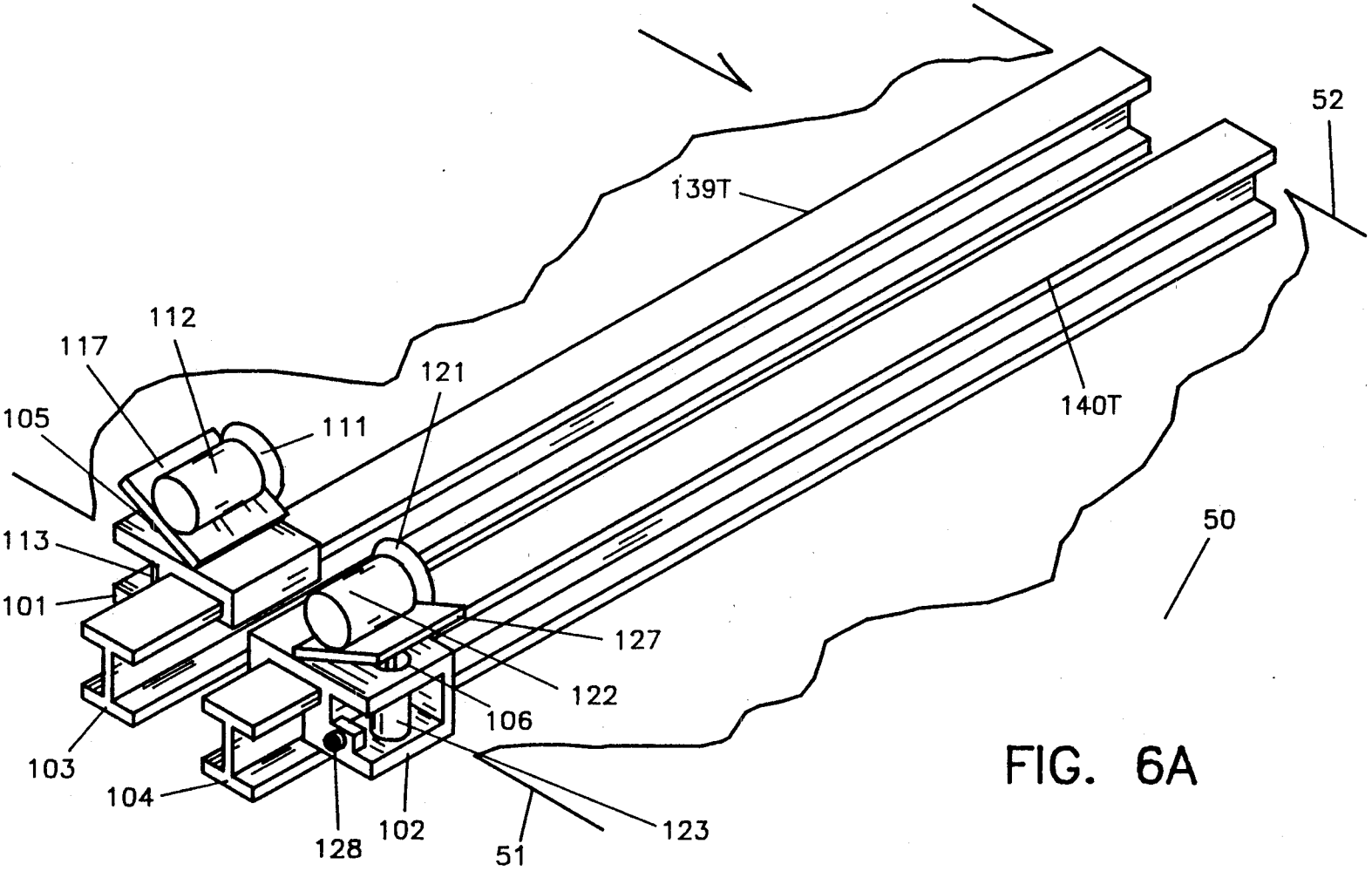

FIG. 6A is an isometric view of a second embodiment of the invention showing the position of its dual beams relative to a continuous web within a paper machine.

Figure 6B:
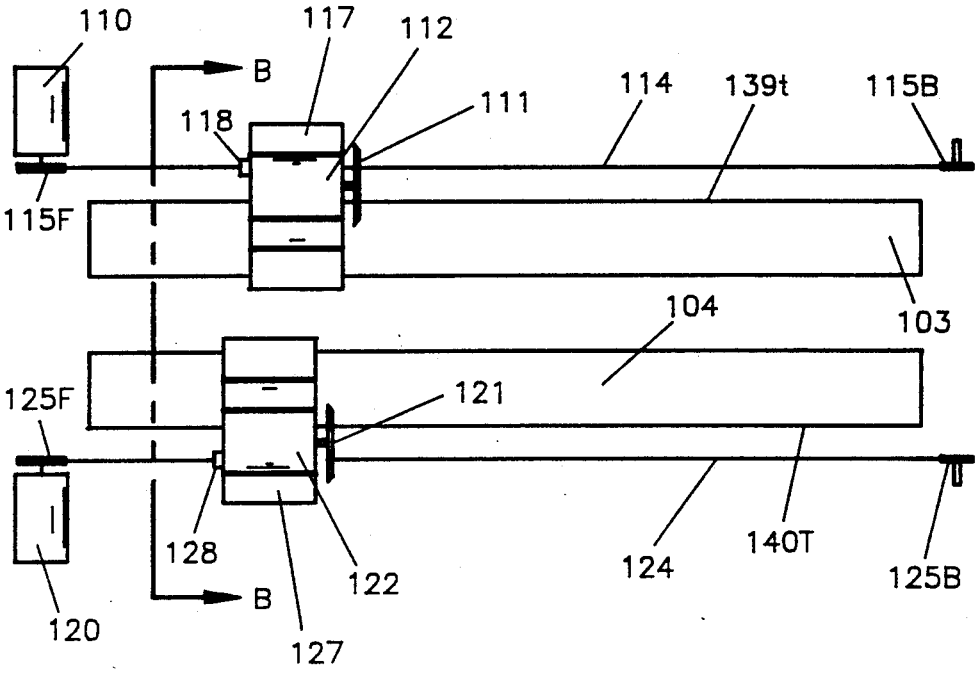
Figure 6C:
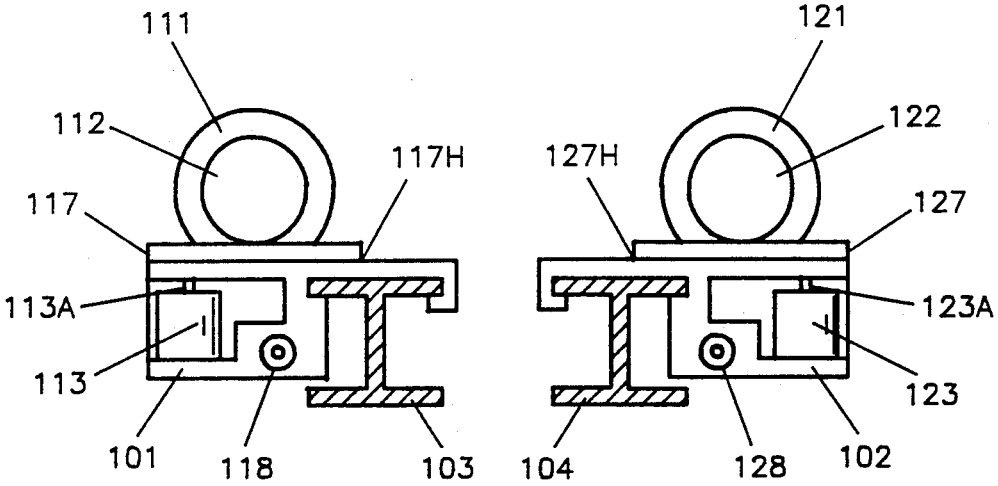

FIGS. 6B and 6C are plan view with vertical section B–B' of the second embodiment of the invention.

Figure 7A:
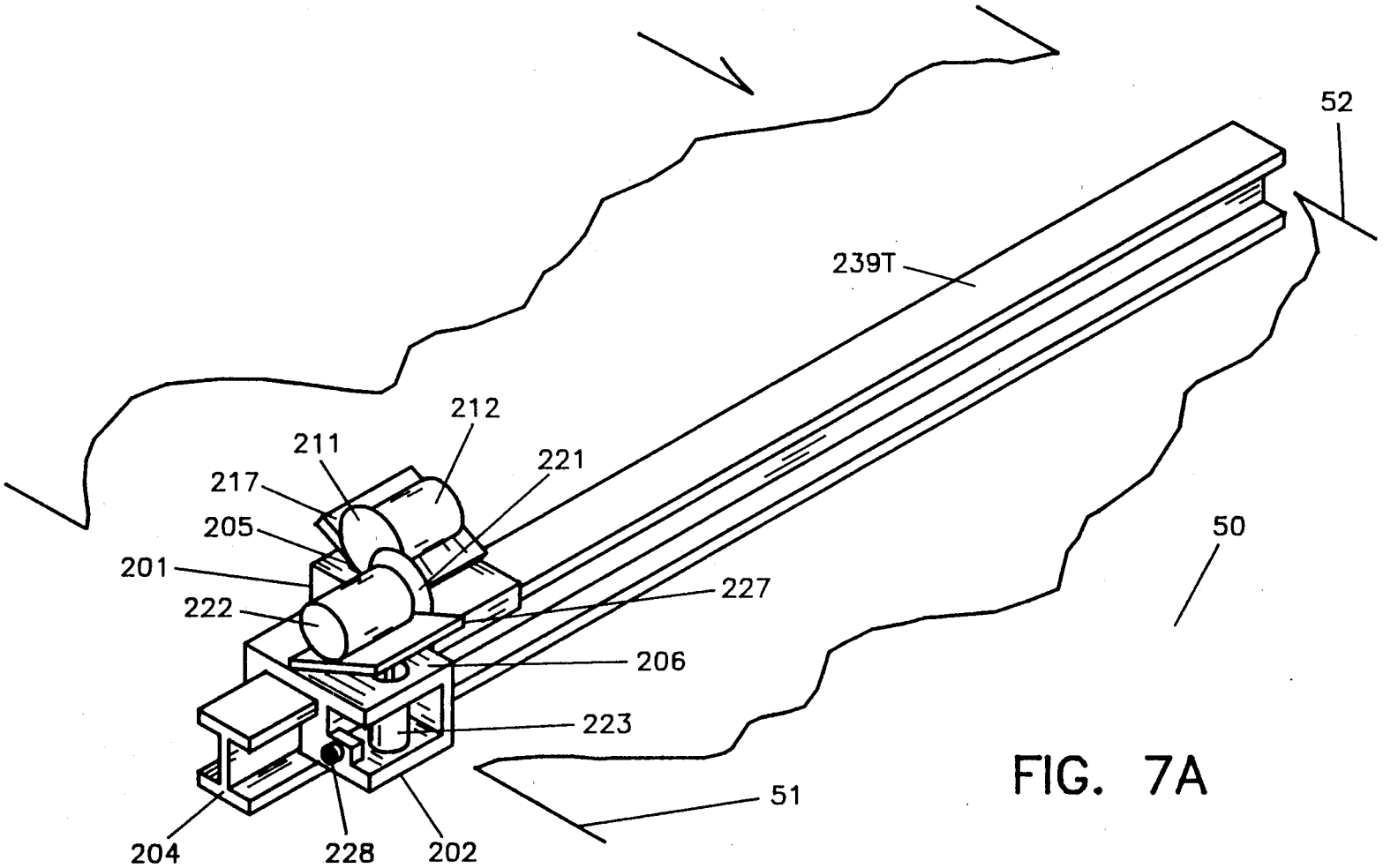

FIG. 7A is an isometric view of a third embodiment of the invention showing the position of its single beam relative to a continuous web within a paper machine.

Figure 7B:
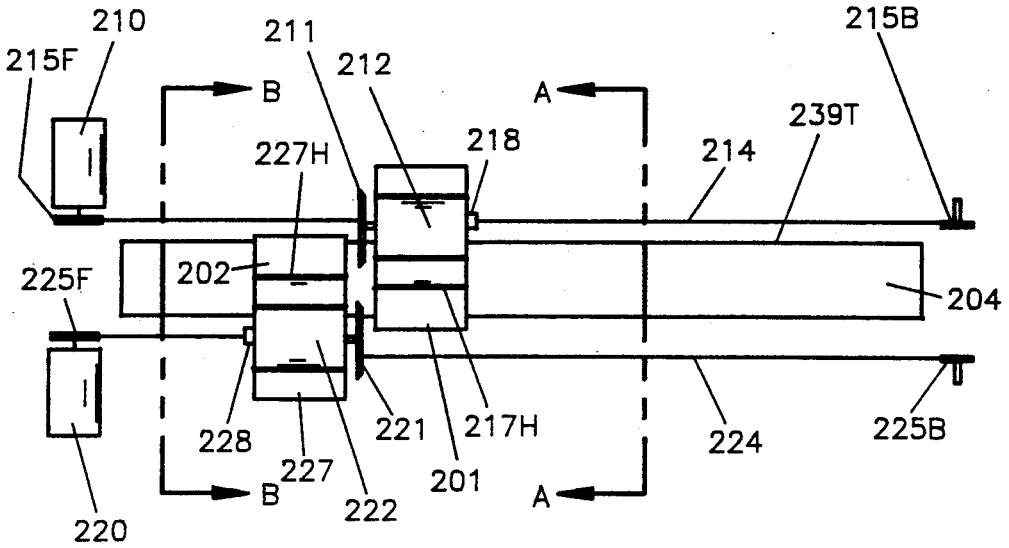
Figure 7C:
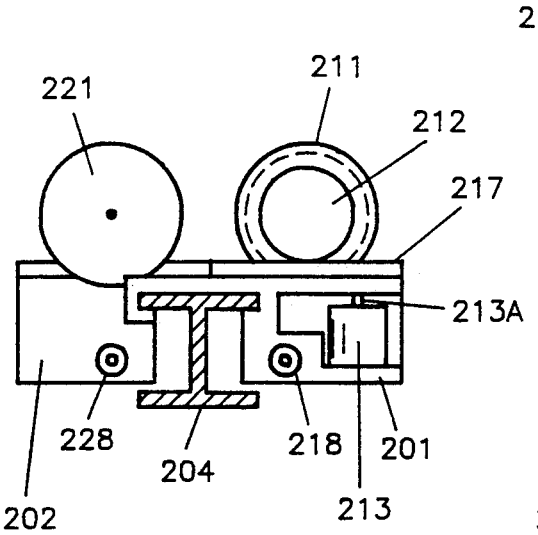
Figure 7D:
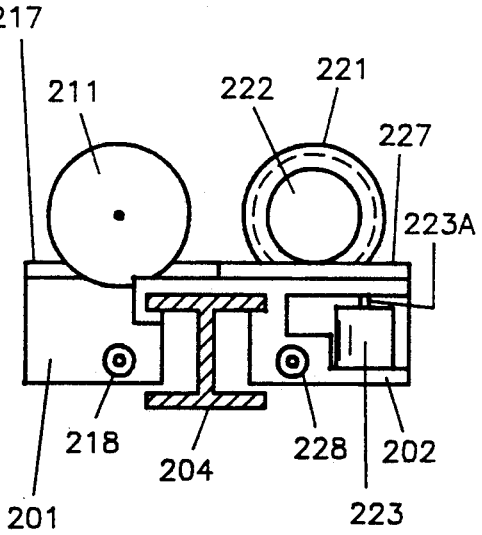

FIGS. 7B, 7C, and 7D are a plan view with vertical sections A–A' and B–B' of the third embodiment of the invention.

Figure 8A:
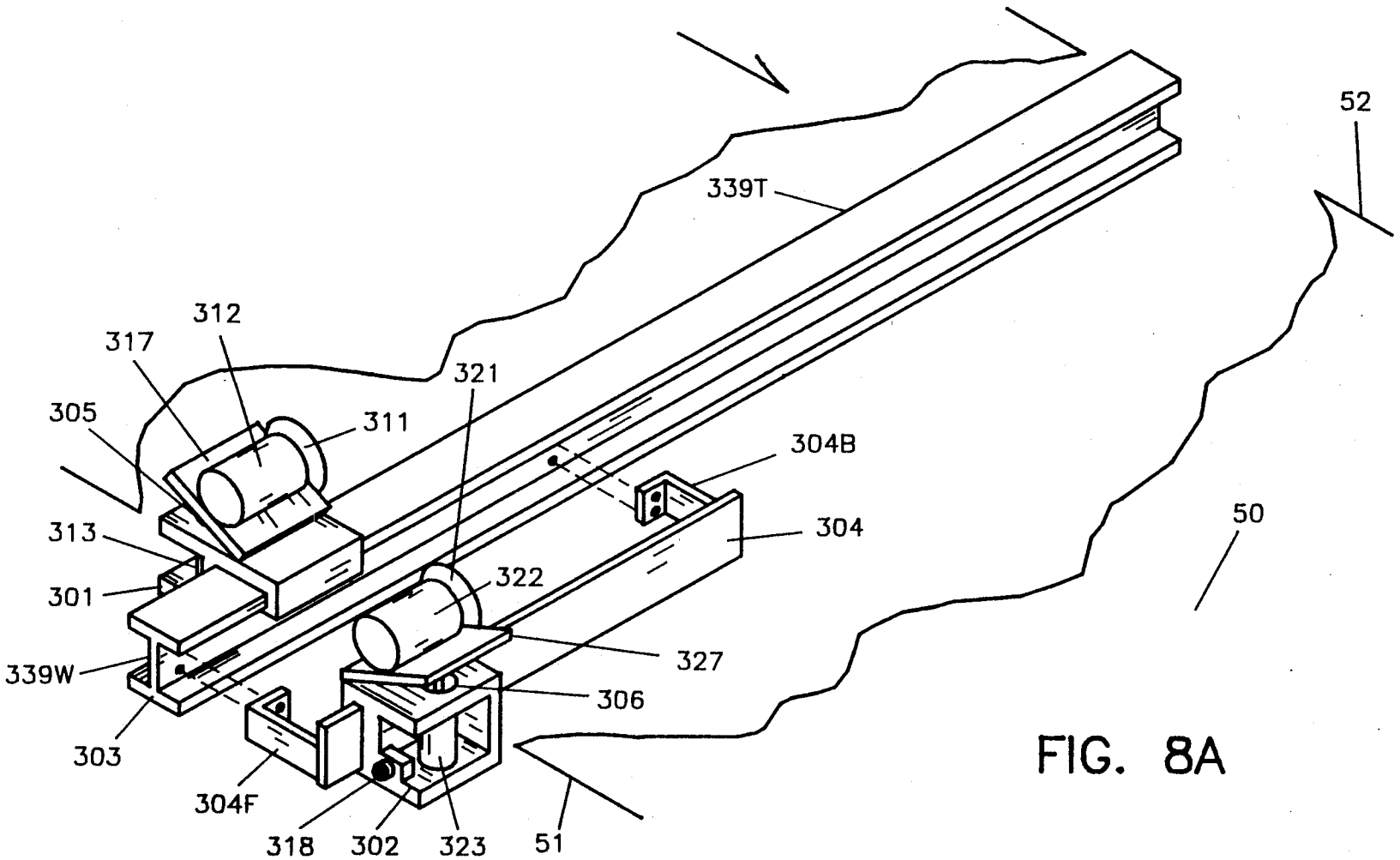

FIG. 8A is an isometric view of a fourth embodiment of the invention showing the long and short beams relative to a continuous web within a paper machine.

Figure 8B:
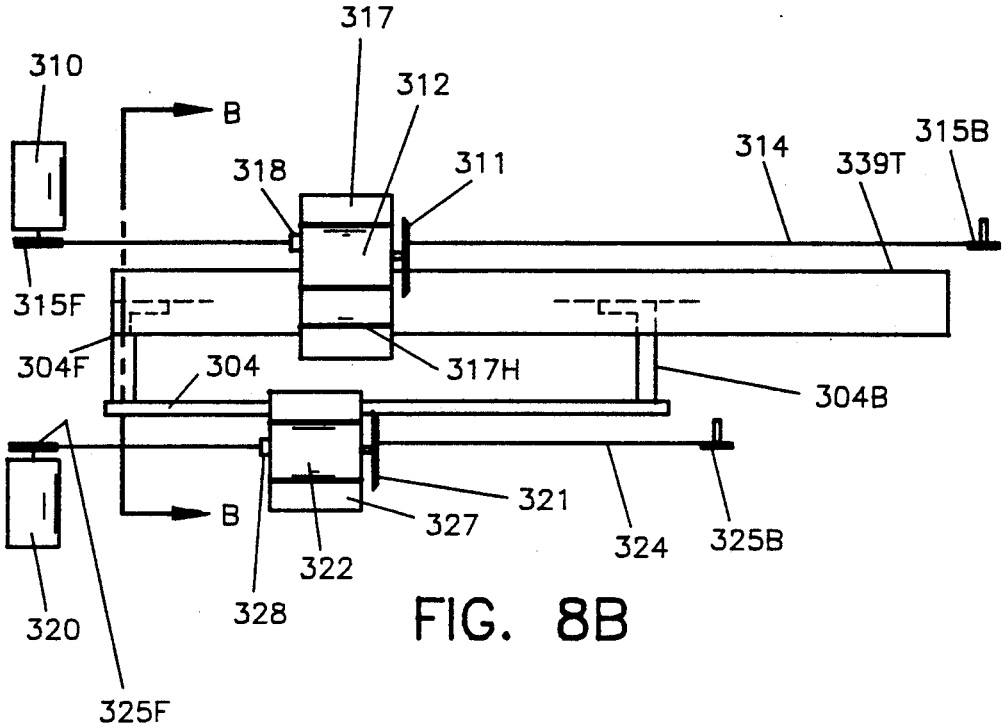
Figure 8C:
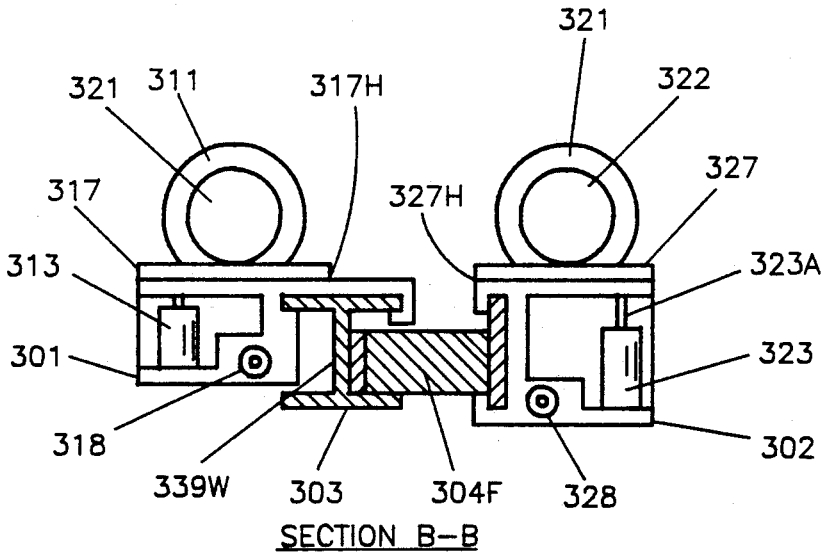
Figure 9A:
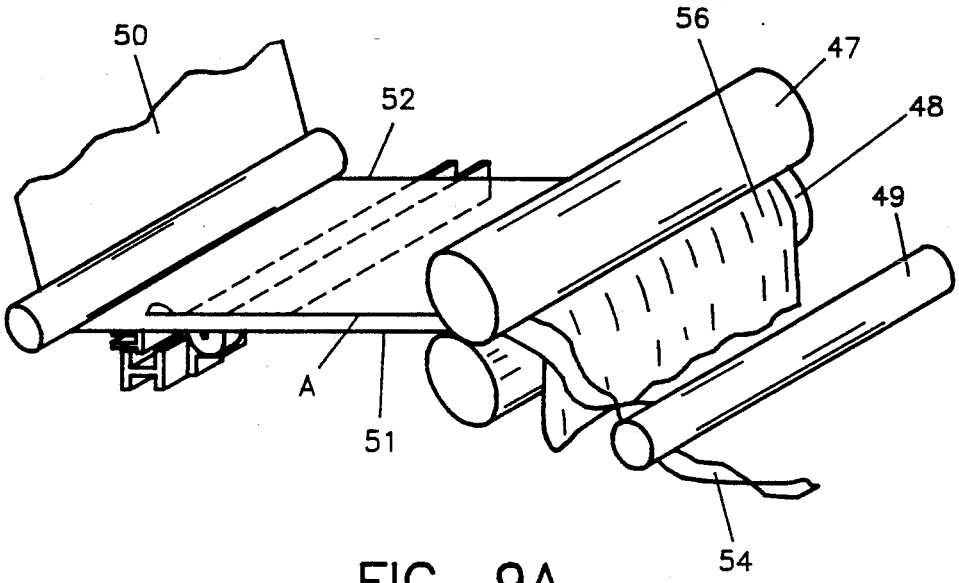
Figure 9B:
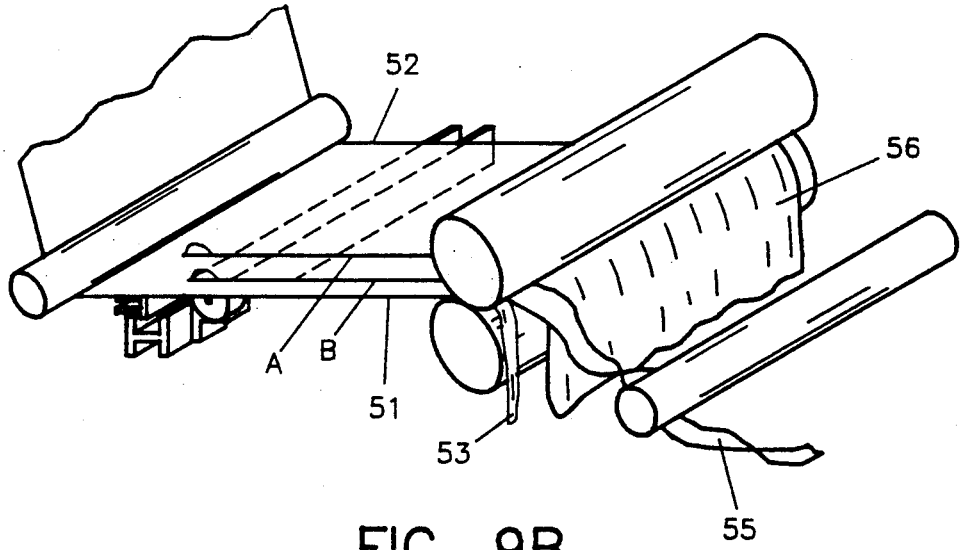
Figure 9C:
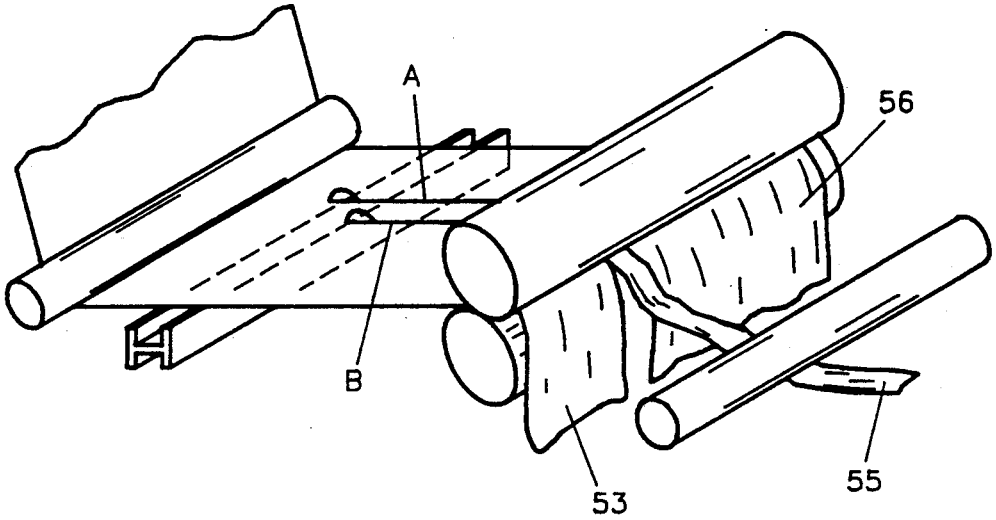
Figure 9D:
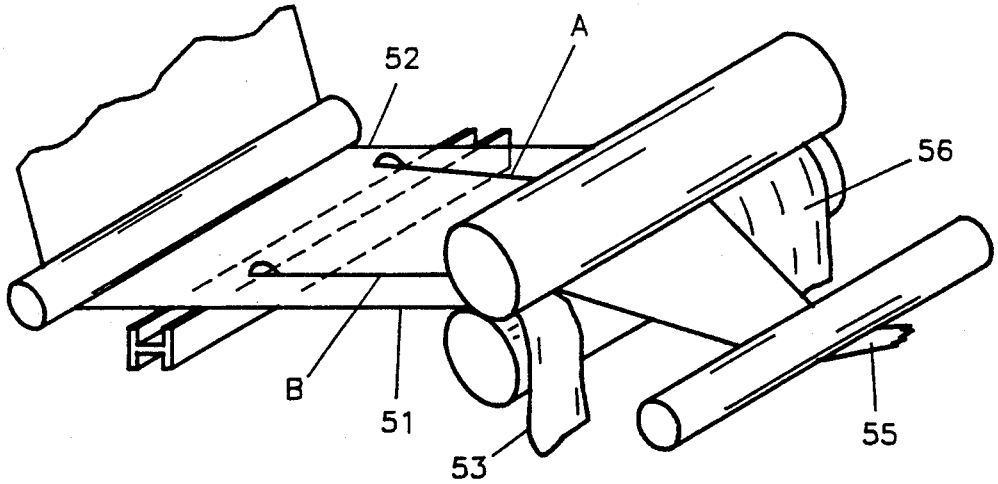

FIGS. 8B and 8C are plan view with vertical section B–B' of the fourth embodiment of the invention.

FIGS. 9A through 9D are isometric drawings showing the forming, traversing and widening of a threading tail using the apparatus and methods of the invention.

Figure 10A:
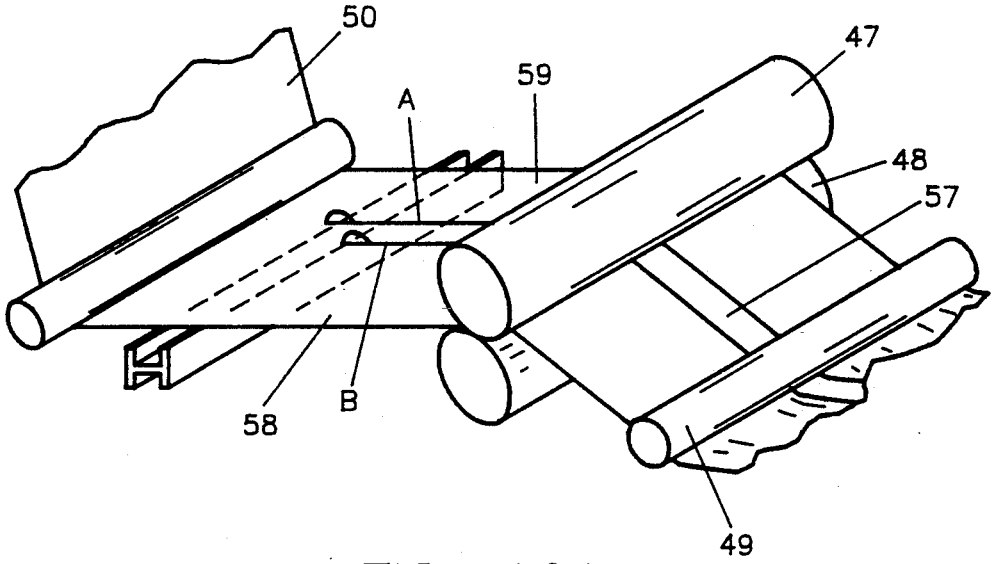
Figure 10B:
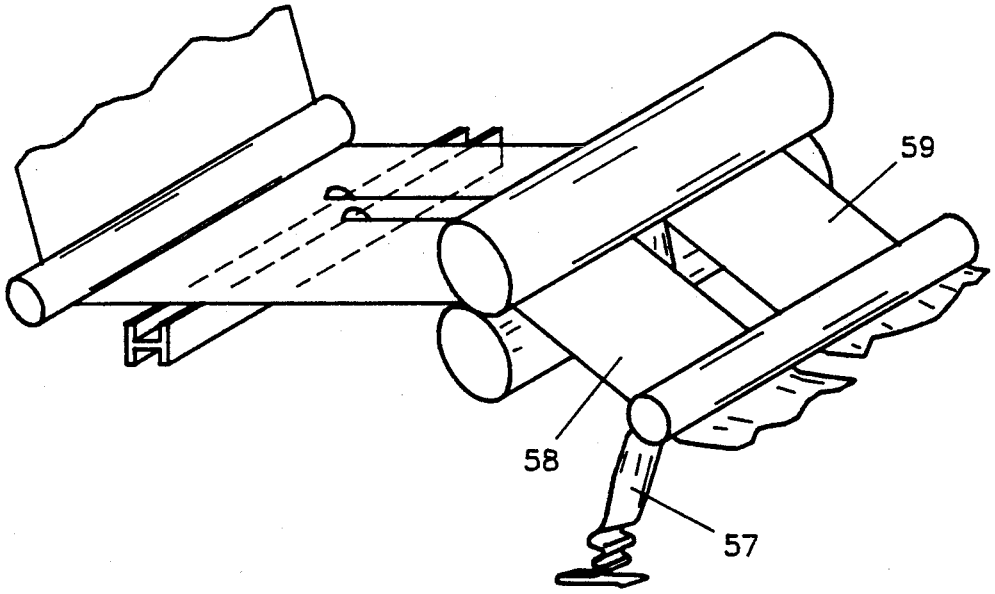
Figure 10C:
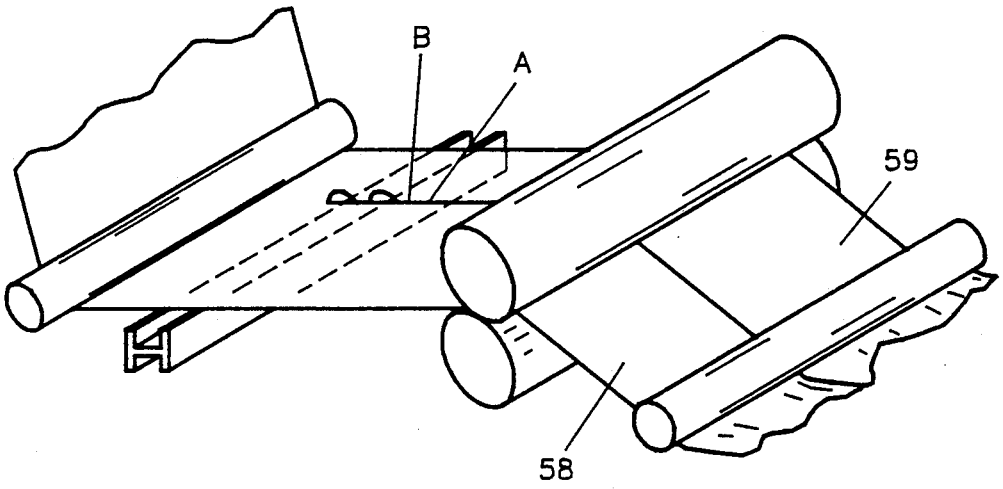

FIGS. 10A through 10C are isometric drawings showing the forming of and recovery from a sample taking method using the apparatus of the invention.

LIST OF REFERENCE NUMERALS

| | |
|---|---|
| A | Designates a slit in web (50) made by an upstream saw |
| B | Designates a slit in web (50) made by a downstream saw |
| 1 | Upstream traversing carriage of preferred embodiment |
| 2 | Downstream traversing carriage of preferred embodiment |
| 3 | Service beam of preferred embodiment |
| 4 | Typical top hitch roll of a paper machine dryer |
| 5 | Clearance hole in (1) |
| 6 | Clearance hole in (2) |
| 7 | Position of tail forming apparatus over wet-end |
| 8 | Position of tail forming apparatus in press-section |
| 9 | Position of tail forming apparatus in dryer-section |
| 10 | Traversing motor for (1) |
| 11 | Cutting saw of (1) |
| 12 | Drive motor of (11) |
| 13 | Cylinder for lifting (11, 12, 17) |
| 14 | Endless chain for traversing (1) |
| 15F | Drive sprocket for (10, 14) |
| 15B | Return sprocket for (10, 14) |
| 16 | Typical bottom hitch roll of a paper machine dryer |
| 17 | Motor mount plate for (1) |
| 17H | Hinge connecting (17) to (1) |
| 18 | Collar for locking chain (14) top (1) |
| 19 | Chute for conveying threading tail |
| 20 | Traversing motor for (2) |
| 21 | Cutting saw of (2) |
| 22 | Drive motor of (21) |
| 23 | Cylinder for lifting (21, 22, 27) |
| 24 | Endless chain for traversing (2) |
| 25F | Drive sprocket for (20, 24) |
| 25B | Return sheave for (20, 24) |
| 26 | Typical return roll for paper machine dryer felt |
| 27 | Motor mount plate for (2) |
| 27H | Hinge connecting (27) to (2) |
| 28 | Collar for locking chain (24) to (2) |
| 29 | Head Box of a fourdrinier paper machine |
| 30 | Breast roll a fourdrinier paper machine |
| 31 | Typical flat (vacuum) box |
| 32 | Endless forming wire of a paper machine |
| 33 | Pick-up roll of a paper machine press section |
| 34 | Endless pick-up felt |
| 35 | Endless top dryer felt |
| 36 | Endless bottom dryer felt |
| 37 | Endless top tail conveying rope |
| 38 | Endless bottom tail conveying rope |
| 39A | Up-stream flange of beam (3) |
| 39B | Down-stream flange of beam (3) |
| 40 | Couch roll of a paper machine's wire section |
| 41 | Wire Turning roll of a wire section |
| 42 | 1st Press Roll of a press section |
| 43 | Center Roll of a press section |
| 44 | Typical dryer can of a paper machine |
| 45 | " |
| 46 | " |
| 47 | Top calender roll of a paper machine |
| 48 | Bottom calender roll |
| 49 | Typical paper carrying roll with rope sheaves |

-continued

| | |
|---|---|
| 50 | Continuous web of paper within a paper machine |
| 51 | Front deckle edge of (50) |
| 52 | Back deckle edge of (50) |
| 53 | Shaving cut from (51) |
| 54 | Threading tail made by conventional apparatus |
| 55 | Threading tail made by the invention |
| 56 | Back side portion of (50) when a tail is formed |
| 57 | Long narrow sample strip of (50) |
| 58 | Front side segment of (50) when (57) is formed |
| 59 | Back side segment of (50) when (57) is formed |
| 97 | Service beam of conventional apparatus |
| 98 | Single carriage of conventional apparatus |
| 99 | Single cutting saw of conventional apparatus |
| 599 | Slit made by saw (99) |

Note: An element of the "other" embodiments are identified by a second and third digit identical to the numerial of the similar part of the preferred embodiment shown in FIG's. 5A and 5B. The first digits vary as follows:
2nd embodiment . . . 1xx
3rd embodiment . . . 2xx
4th embodiment . . . 3xx

DESCRIPTION OF INVENTION

Drawings are included to show four embodiments of the invention. Sufficient detail is shown to permit those knowledgeable in the art of paper making to appreciate how various configurations of the improvement may be put into practice. In this regard, the drawings must be read in conjunction with the claims.

(1) Preferred embodiment

Referring to FIGS. 5A through 5D wherein the preferred embodiment of the invention is shown to be comprised in part of:

A service beam 3 distinguished by flanges 39A and 39B spaced such that traversing carriages 1 and 2 and all elements attached thereon pass one another without interference, extends transversely and parallel to web 50. The length of the beam 3 is sufficient to allow cutting saws 11 and 21 to pass beyond deckle edges 51 and 52 of web 50.

An upstream traversing carriage 1 mounted to slide along flange 39A of beam 3 supports; a cutting saw 11 mounted on the shaft of drive motor 12; a motor mount plate 17 to which motor 12 is bolted; a hinge 17H connects plate 17 to carriage 1 such that assembly 17,12,11 pivots toward the plane of web 50; a cylinder 13 with clevis base is bolted to an interior surface of carriage 1, piston rod 13A of cylinder 13 extends through clearance hole 5 allowing the clevis of the rod end to be bolted to the underside of plate 17.

A variable speed and reversible drive comprises; a traversing motor 10 with a drive sprocket 15F mounted on its shaft, base of said motor 10 is bolted either to a static element of the paper machine or on one end of beam 3; a return sprocket 15B mounted either to a static element of the paper machine or to the opposite end of beam 3 but in either case, at machine side opposite sprocket 15F; an endless chain 14 circumvents sprockets 15F and 15B and is attached to traversing carriage 1 by collar 18 such that rotary power supplied by motor 10 causes carriage 1 to traverse in either direction along flange 39F of beam 3.

A downtream traversing carriage 2 mounted to slide along flange 39B of beam 3 supports; a cutting saw 21 mounted on the shaft of drive motor 22; a motor mount plate 27 to which motor 22 is bolted; a hinge 27H connects plate 27 to carriage 1 such that assembly 27,22,21 pivots toward the plane of web 50; a cylinder 23 with clevis base is bolted to an interior surface of carriage 2, piston rod 23A of cylinder 23 extends through clearance hole 6 allowing the clevis of the rod end to be bolted to the underside of plate 27.

A variable speed and reversible drive comprises; a traversing motor 20 with a drive sprocket 25F mounted on its shaft, base of said motor 20 is bolted either to a static element of the paper machine or on one end of beam 3; a return sprocket 25B mounted either to a static element of the paper machine or to the opposite end of beam 3 but in either case, at machine side opposite sprocket 25F; an endless chain 14 circumvents sprockets 25F and 25B and is attached to traversing carriage 2 by collar 28 such that rotary power supplied by motor 20 causes carriage 2 to traverse in either direction along flange 39B of beam 3.

(2) Second embodiment

Referring to FIGS. 6A through 6C wherein a second embodiment of the invention is shown to be comprised in part of:

A service beam 103 distinguished by flange 139T extends transversely and parallel to web 50 of length to allow saw 111 to pass beyond deckle edges 51 and 52 of web 50.

An upstream traversing carriage 101 mounted to slide along flange 139T of beam 103 supports; a cutting saw 111 mounted on the shaft of drive motor 112; a motor mount plate 117 to which motor 112 is bolted; a hinge 117H connects plate 117 to carriage 101 such that assembly 117,112,111 pivots toward the plane of web 50; a cylinder 113 with clevis base is bolted to an interior surface of carriage 101, piston rod 113A of cylinder 113 extends through clearance hole 105 allowing the clevis of the rod end to be bolted to the underside of plate 117.

A variable speed and reversible drive comprises; a traversing motor 110 with a drive sprocket 115F mounted on its shaft, base of said motor 110 is bolted either to a static element of the paper machine or on one end of beam 103; a return sprocket 115B mounted either to a static element of the paper machine or to the opposite end of beam 103 but in either case, at machine side opposite sprocket 115F; an endless chain 114 circumvents sprockets 115F and 115B and is attached to traversing carriage 101 by collar 118 such that rotary power supplied by motor 110 causes carriage 101 to traverse in either direction along flange 139F of beam 103.

A service beam 104 distinguished by flange 140T extends transversely and parallel to web 50 of length to allow saw 121 to pass beyond deckle edges 51 and 52 of web 50.

A downstream traversing carriage 102 mounted to slide along flange 140T of beam 104 supports; a cutting saw 121 mounted on the shaft of drive motor 122; a motor mount plate 127 to which motor 122 is bolted; a hinge 127H connects plate 127 to carriage 102 such that assembly 127,122,121 pivots toward the plane of web 50; a cylinder 123 with clevis base is bolted to an interior surface of carriage 102, piston rod **123*a* of cylinder 123 extends through clearance hole 106 allowing the clevis of the rod end to be bolted to the underside of plate 127**.

A variable speed and reversible drive comprises; a traversing motor 120 with a drive sprocket 125F mounted on its shaft, base of said motor 120 is bolted either to a static element of the paper machine or on one end of beam 104; a return sprocket 125B mounted either to a static element of the paper machine or to the opposite end of beam 104 but in either case, at machine side opposite sprocket 125F; an endless chain 124 circumvents sprockets 125F and 125B and is attached to traversing carriage 102 by collar 128 such that rotary power supplied by motor 120 causes carriage 102 to traverse in either direction along flange 140F of beam 104.

(3) Third embodiment

Referring to FIGS. 7A through 7D wherein the third embodiment of the invention is shown to be comprised in part of:

A service beam 204 distinguished by flange 239T extends transversely and parallel to web 50 of length to allow saws 211 and 221 to pass beyond deckle edges 51 and 52 of web 50.

An upstream traversing carriage 201 mounted to slide along flange 139F of beam 103.

A service beam 104 distinguished by flange 140T extends transversely and parallel to web 50 of length to allow saw 121 to pass beyond deckle edges 51 and 52 of web 50.

A downtream traversing carriage 102 mounted to slide along flange 140T of beam 104 supports; a cutting saw 121 mounted on the shaft of drive motor 122; a motor mount plate 127 to which motor 122 is bolted; a hinge 127H connects plate 127 to carriage 102 such that assembly 127,122,121 pivots toward the plane of web 50; a cylinder 123 with clevis base is bolted to an interior surface of carriage 102, piston rod of cylinder 123 extends through clearance hole 106 allowing the clevis of the rod end to be bolted to the underside of plate 127.

A variable speed and reversible drive comprises; a traversing motor 120 with a drive sprocket 125F mounted on its shaft, base of said motor 120 is bolted either to a static element of the paper machine or on one end of beam 104; a return sprocket 125B mounted either to a static element of the paper machine or to the opposite end of beam 104 but in either case, at machine side opposite sprocket 125F; an endless chain 124 circumvents sprockets 125F and 125B and is attached to traversing carriage 102 by collar 128 such that rotary power supplied by motor 120 causes carriage 102 to traverse in either direction along flange 140F of beam 104.

(3) Third embodiment

Referring to FIG. 7A and FIG. 7B wherein the third embodiment of the invention is shown to be comprised in part of:

A service beam 204 distinguished by flange 239T extends transversely and parallel to web 50 of length to allow saws 211 and 221 to pass beyond deckle edges 51 and 52 of web 50.

An upstream traversing carriage 201 mounted to slide along flange 239T of beam 204 supports; a cutting saw 211 mounted on the shaft of drive motor 212; a motor mount plate 217 to which motor 212 is bolted, the centerline of said motor being offset somewhat upstream in the machine direction; a hinge 217H connects plate 217 to carriage 201 such that assembly 217,212,211 pivots toward the plane of web 50; a cylinder 213 with clevis base is bolted to an interior surface of carriage 201, piston rod 213A of cylinder 213 extends through clearance hole 205 allowing the clevis of the rod end to be bolted to the underside of plate 217.

A variable speed and reversible drive comprises; a traversing motor 210 with a drive sprocket 215F mounted on its shaft, base of said motor 210 is bolted either to a static element of the paper machine or on one end of beam 204; a return sprocket 215B mounted either to a static element of the paper machine or to the opposite end of beam 204 but in either case, at machine side opposite sprocket 215F; an endless chain 214 circumvents sprockets 215F and 215B and is attached to traversing carriage 201 by collar 218 such that rotary power supplied by motor 210 causes carriage 201 to traverse in either direction along flange 239T of beam 204.

A downstream traversing carriage 202 mounted to slide along flange 239T of beam 204 supports; a cutting saw 221 mounted on the shaft of drive motor 222; a motor mount plate 227 to which motor 222 is bolted, the centerline of said motor being offset somewhat downstream in the machine direction sufficiently that saws 211 and 221 can assume identical cross machine positions; a hinge 227H connects plate 227 to carriage 202 such that assembly 227,222,221 pivots toward the plane of web 50; a cylinder 223 with clevis base is bolted to an interior surface of carriage 202, piston rod 223a of cylinder 223 extends through clearance hole 206 allowing the clevis of the rod end to be bolted to the underside of plate 227.

A variable speed and reversible drive comprises; a traversing motor 220 with a drive sprocket 225F mounted on its shaft, base of said motor 220 is bolted either to a static element of the paper machine or on one end of beam 204; a return sprocket 225B mounted either to a static element of the paper machine or to the opposite end of beam 204 but in either case, at machine side opposite sprocket 225F; an endless chain 224 circumvents sprockets 225F and 225B and is attached to traversing carriage 202 by collar 228 such that rotary power supplied by motor 220 causes carriage 202 to traverse in either direction along flange 239T of beam 204.

(4) Fourth embodiment

Referring to FIGS. 8A through 8C wherein the fourth embodiment of the invention is shown to be comprised in part of:

A service beam 303 distinguished by flange 339T extends transversely and parallel to web 50 of length sufficient to allow cutting saw 311 to pass beyond deckle edges 51 and 52 of web 50.

An upstream traversing carriage 301 mounted to slide along flange 339T of beam 303 supports; a cutting saw 311 mounted on the shaft of drive motor 312; a motor mount plate 317 to which motor 312 is bolted; a hinge 317H connects plate 317 to carriage 301 such that assembly 317,312,311 pivots toward the plane of web 50; a cylinder 313 with clevis base is bolted to an interior surface of carriage 301, piston rod of cylinder 313 extends through clearance hole 305 allowing the clevis of the rod end to be bolted to the underside of plate 317.

A variable speed and reversible drive comprises; a traversing motor 310 with a drive sprocket 315F mounted on its shaft, base of motor 310 is bolted either to a static element of the paper machine or on one end of beam 303; a return sprocket 315B mounted either to a static element of the paper machine or to the opposite end of beam 303 but in either case, at machine side opposite sprocket 315F; an endless chain 314 circumvents sprockets 315F and 315B is attached to traversing carriage 301 by collar 318 such that rotary power supplied by motor 310 causes carriage 301 to traverse in either direction along flange 339F of beam 303.

A downstream service beam 304 extending transversely and parallel to the plane of web 50 and beam 303 of length sufficient to allow cutting saw 321 to pass beyond the deckle edge 51 of said web 50 and to allow said saw 321 to also move some distance toward the center of the paper machine. Said beam 304 may be mounted by brackets 304F and 304B to beam 303 such that carriages 301 and 302 can be traversed without interfering with one another. Said beam 304 may optionally be mounted as a free-standing unit.

A downtream traversing carriage 302 mounted to slide along beam 303 supports; a cutting saw 321 mounted on the shaft of drive motor 322; a motor mount plate 327 to which motor 322 is bolted; a hinge 327H connects plate 327 to carriage 302 such that assembly 327,322,321 pivots toward the plane of web 50; a cylinder 323 with clevis base is bolted to an interior surface of carriage 301, the piston rod **323*a* cylinder 323 extends through clearance hole 306 allowing the clevis of the rod end to be bolted to the underside of plate 327**.

A variable speed and reversible drive comprises; a traversing motor 320 with a drive sprocket 325F mounted on its shaft, base of motor 320 is bolted either to a static element of the paper machine or on one end of beam 304; a return sprocket 325B mounted either to a static element of the paper machine or to the opposite end of beam 304 but in either case, at machine side opposite sprocket 325F; an endless chain 324 circumvents sprockets 325F and 325B is attached to traversing carriage 302 by collar 328 such that rotary power supplied by motor 320 causes carriage 302 to traverse in either direction on beam 304.

OPERATION OF THE INVENTION

(1) Tail making

Using the preferred embodiment

Refer now to drawings of the invention FIGS. 5A, 5B, 5C, 9A, 9B, 9C, 9D and drawings showing conventional apparatus FIGS. 3,3A,4B,4C,4D.

On the occasion of web 50 breaking at a point down stream from the nip of calender rolls 47 and 48, traversing carriages 1 and 2 with saws 11 and 21 lowered, are moved along service beam 3 to the front or tending side of the paper machine by their respective drive assemblies 10,15F, 15B,14 and 20, 25F,25B,24.

With saw 21 still retracted, carriage 2, by action of drive assembly 20,25F,25B,25, is moved along beam 3 to a predetermined stand-by position beneath web 50 such that said saw is 1 or 2 inches inside of deckle edge 51. The actual position is found by experience.

With saw 11 still retracted, carriage 1, by action of drive assembly 10,15F,15B,14, is moved along beam 3 to a predetermined stand-by position beneath web 50 such that said saw is from 5 to 8 inches inside of deckle edge 51. The actual position of said saw respective to said deckle edge is found by experience to produce the best width tail for threading the particular downstream machine section.

On command of the operator, cylinder 13 is activated raising assembly 17,12 so that upstream saw 11 penetrates web 50 making slit A creating threading tail 54 and web segment 56 from main web 50. Said tail 54 is identical in every way with the threading tails made using convention apparatus (see FIG. 4B). Said tail 54 is likewise fed into the down stream machine section's rope conveyors by conventional methods (see FIGS. 3 and 3A).

Somewhat simultaneously with the entrance of tail 54 into the nip of the rope conveyor, either operator or computer activates cylinder 23 thus raising assembly 27,22,21 causing downstream saw 21 to penetrate web 50 making slit B thereby, together with deckle edge 51, creating shaving 53. Slit B transforms tail 54 into the new and unique movable tail 55.

From this moment on, the method of the invention differs from that of conventional apparatus.

Somewhat simultaneously with the creation of shaving 53, said shaving is broken by the operator as it exits the nip of calender rolls 47,48 thereby causing said shaving to fall into a repulper already receiving web segment 56 of main web 50. (see FIG. 9B).

Depending upon the peculiarities of the individual machine but in any case very soon after the breaking of shaving 53, both carriages 1 and 2 are moved by their respective traversing drives 10,15F,15B,14 and 20,25F,25B,24 along beam 3 to positions nearer the centerline of the paper machine. Although the rate of travel of carriages 1 and 2 may be identical, in which case movable tail 55 maintains its initial width, carriage 1 may be traversed at a faster rate than carriage 2 thereby causing tail 55 to widen as it progresses toward the machine center. On this occasion, it will be apparent to practioners of the art that computer control of the traversing movements of carriages 1 and 2 will allow the operator to concentrate on the difficult task of increasing the draw, secure in the knowledge that tail 55 cannot meander off the ends of downstream rolls.

As the operator increases the speed or draw between calender nip 47,48 and the downstream section being threaded, tail 55 begins to stabilize as it experiences the normal running tension for that draw. At this moment, carriages 1 and 2 are commanded to move in opposite directions. By the action of traversing drive 10,15F,15B,14, carriage 1 is traversed toward deckle edge 52 while the traversing drive 20,25F,25B, 24 traverses carriage 2 back towards deckle edge 51. See FIG. 9D. By the above described action, slits A and B move apart and so-formed tail 55 is widened symmetrically; a shape better able to handle the somewhat symmetrically arrayed tensions normally found in drying webs than is the oblique shaped tail made by conventional apparatus (see FIG. 4D).

The threading of a section is completed when saws 11 and 21 thus slits A and B pass respectively beyond deckle edges 52 and 51.

Using the 2nd embodiment

Refer now to drawings of the invention FIGS. 6A, 6B, 6C, 9A, 9B, 9C 9D and drawings showing conventional apparatus FIGS. 3,3A,4B,4C,4D.

The methods just described are duplicated in every detail.

Using the 3rd embodiment

Refer now to drawings of the invention FIGS. 7A, 7B, 7C, 7D, 9B, 9C 9D and drawings showing conventional apparatus FIGS. 3,3A,4B,4C,4D.

The methods just described are duplicated in every detail.

Using the 4th embodiment

Refer now to drawings of the invention FIGS. 8A, 8B 8C, 9A, 9B, 9C 9D and drawings showing conventional apparatus FIGS. 3,3A,4B,4C,4D.

The length of service beam 304 determines whether or not the operation of this embodiment can exactly duplicate the methods of the preferred embodiment. It is obvious that the length of beam 304 determines the extent that traversing carriage 302 can approach the center of the machine. Depending upon the peculiarities of the paper machine site, it may be judged unnecessary to move tail 55 a great distance from the ends of downstream rolls in which case beam 304 may be appropriately shortened.

Within the limits just described, the operation is in fact duplicated in every way with those detailed for the preferred embodiment.

(2) Sample making

Using the preferred embodiment

Refer now to drawings of the invention FIGS. 5A, 5B, 5C, 10A, 10B, and 10C

With saw 21 still retracted, carriage 2, by action of drive assembly 20,25F,25H,25, is moved along beam 3 to a predetermined stand-by position beneath web 50 such that said saw is directly on the center line of the sample to be taken.

With saw 11 still retracted, carriage 1, by action of drive assembly 10,15F,15B,14, is moved along beam 3 to a predetermined stand-by position beneath web 50 such that said saw is directly on the center line of the sample to be taken.

Carriages 1 and 2 are then caused to be traversed in equal but opposite directions, the former towards deckle edge 52 and the latter towards deckle edge 51 such that saws 11 and 21 will be precisely separated by a distance equal to the width of the desired sample.

On command of the operator, cylinder 13 is activated raising assembly 17,12 causing upstream saw 11 to penetrate web 50 making slit A. Likewise, cylinder 23 is activated raising assembly 27,12 causing saw 21 to make slit B (see FIG. 10A).

At this phase of the method, three separate webs 57,58 and 59 continue to traverse the full length of the machine.

A crew member enters the machine at a draw between sections where a sample is desired but specifically immediately downstream from a nip such as calender 47,48, reaches up and breaks web segment 57 to cause said segment to drop to the machine floor See FIG. 10B. Web segments 58 and 59 continue down the length of the paper machine to the reel.

Once sufficient paper is gathered for sampling purposes and, if another sample of a different cross-machine position is to be taken from the same draw site, a computer of operator causes carriages 1 and 2 to traverse in unison such that the distance between saws 11 and 21 are maintained, stopping said saws astride the centerline of the next sampling position.

The above procedure is repeated until all samples are gathered at which time, carriages 1 and 2 are traversed toward one another until slits A and B assume identical cross-machine positions. By this action, the gap in web 50 made by sample segment 57 disappears. Segments 58 and 59 continue on through the machine to the reel. See FIG. 10C.

The sample procedure is completed when the saws 11 and 21 are caused to be retracted.

Using the 2nd embodiment

Refer now to drawings of the invention FIGS. 6A, 6B, 6C, 10A, 10B, and 10C

The methods just described are duplicated in every detail.

Using the 3rd embodiment

Refer now to drawings of the invention FIGS. 7A, 7B, 7C, 7D, 10A, 10B, and 10C

The methods just described are duplicated in every detail.

Using the 4th embodiment

Refer now to drawings of the invention FIGS. 8A, 8B, 10A, 10B, and 10C

The length of service beam 304 determines whether or not the operation of this embodiment can exactly duplicate the methods of the preferred embodiment. It is obvious that the length of beam 304 determines the cross-direction width over which traversing carriage 302 can be traversed but in any case, the shorter length of said beam limits the width of main web 50 from which tending or front side samples can be taken.

Therefore, within the length constraints of beam 304, the methods just described are duplicated in every detail.

CONCLUSION AND SCOPE OF INVENTION

Thus the reader will see that the independently moved and actuated dual cutting means of the apparatus and the coordination of said cutting tools of the method allow the threading tail of the invention to be uniquely and beneficially moved and then widened symmetrically.

Persons skilled in the art of paper making will also appreciate that the invention provides a unique and time saving secondary use for obtaining cross-machine samples anywhere across a paper web and to do so without losing the continuity of the web's path to the reel.

While my descriptions contain many specifications, these should not be construed as limitations on the scope of the invention, but rather as examples and exemplification of a preferred and three further embodiments thereof. For example, throughout the specifications, a circular saw was used by way of example to show the general arrangement and method of the invention's apparatus. As was shown under prior art, it is customary to have tail forming equipment sited over the fourdrinier section and if not there than within the press section of a paper machine. In both instances, it is necessary to use water jets to cut the still wet and tender web. It is specifically pointed out that all four embodiments of the invention can equally well be outfitted with water jets to affect the necessary cuts in those two wet end sites of a paper machine. Obviously, in the case of water jets, the simple turning on and off of the supply replaces the saw activating components used in dry-end applications.

The use of an H-beam shape to denote the service beam for conventional apparatus and the embodiments of the invention are only by way of example; the fact is, many other structural shapes such as tubular, box and triangular shaped beams can be used successfully. Likewise, the particulars of the traversing carriages and the parts mounted thereon are used for clarity and only by way of example. Although not in common use, there are occasions when a non-rotating knife or pointed spear is used to affect the necessary cuts in the main web.

Finally, the apparent proximity of the service beams of the second and fourth embodiments as shown in FIG's 6A and 8A is merely to make the drawings compact. In fact, the two beams of these embodiments can be separated by many feet and still fulfill their objects.

Accordingly, the scope of the invention should be determined not by the embodiments illustrated, but by the appended claims and their legal equivalents.

Wherein what is claimed is:

1. In a paper machine, apparatus for cutting a tail from a paper web and selectively moving the tail across the paper web during the threading operation of the paper machine, the apparatus comprising:

a. two traversable carriages on each of which is mounted a web cutting means for slitting said paper web;

b. a single transverse service beam means for mounting, driving and guiding said two traversable carriages across substantially the full width of the web as the web is moved through the paper machine, the first of said traversable carriages being selectively placed at a first selected position relative to the web, and the second of said traversable carriages being selectively placed to cause the associated web cutting means to slit the paper web at a predetermined, variable position, the respective placements of the two traversable carriages on the beam means allowing the two web cutting means to pass each other while the two traversable carriages move across the web.

2. In a paper machine, apparatus for cutting and moving a tail for connection with the threading operation of a paper machine comprising a. a single transverse service beam with drive, mount and guide means for independently moving two traversing carriages across the full width of said web, and b. two traversable carriages on each of which is mounted a web cutting means; said cutting means being mounted oppositely offset in the machine direction to allow the two cutting means to take identical cross machine positions on said service beam.

3. A method for cutting a tail from a paper web in a paper forming machine comprising the steps of providing a first cutting means capable of being variably and selectively positioned across substantially the full width of the paper web, providing a second cutting means capable of being variably and selectively positioned across substantially the full width of the paper web, initially positioning said first and second cutting means at an initial cutting position relative to the paper web, cutting a tail from the paper web while the paper web is passing through the paper machine, repositioning the first and second cutting means while the paper web is passing through the paper machine to reposition the portion of the web from which the tail is cut, and driving the first and second cutting means toward opposite edges of the web.

4. The method of claim 3 further including the step of cutting sample strips from a continuous web.

5. The method of claim 3 wherein the initial cutting position is at an edge of the web and the repositioning step involves moving the tail to the center of the web.

* * * * *